US005209463A

United States Patent [19]

Gleason et al.

[11] Patent Number: 5,209,463

[45] Date of Patent: May 11, 1993

[54] SIGNATURE PILE LIFT MECHANISM FOR DEMOGRAPHIC BINDERY LINE

[75] Inventors: Donald R. Gleason; Michael A. Barenklau, both of Waseca, Minn.

[73] Assignee: Brown Printing Company, a Division of Gruner & Jahr Printing and Publishing Co., Waseca, Minn.

[21] Appl. No.: 934,974

[22] Filed: Aug. 25, 1992

[51] Int. Cl.[5] ..... B65H 3/08

[52] U.S. Cl. ..... 271/11; 271/101; 271/106; 271/113

[58] Field of Search ..... 271/11, 100, 101, 106, 271/113

[56] References Cited

U.S. PATENT DOCUMENTS

| | | | |
|---|---|---|---|
| 2,797,092 | 6/1957 | Welsh | 271/113 X |
| 3,702,187 | 11/1972 | Hageman | 271/113 X |
| 3,741,535 | 6/1973 | Palkovic | 271/113 X |

*Primary Examiner*—Richard A. Schacher
*Attorney, Agent, or Firm*—Haugen and Nikolai

[57] ABSTRACT

A conventional pocket for delivering signatures in a bindery line is modified by providing a lift plate which is hinged to the leading edge of the pocket's signature support tray. A suitable actuator under control of the system's computer is made to raise and lower that lift plate, depending upon the number of machine cycles which will be executed before that particular pocket will be called upon to deliver a signature to the magazine being assembled. If more than a predetermined number of machine cycles will take place before a signature must be delivered, the actuator lifts the lift plate and, in doing so, elevates the leading edge of the signature stack to the point where the lowermost signature is positioned out of contact with the hopper's separator disc. This prevents unwanted abrasion and marring of signatures.

6 Claims, 2 Drawing Sheets

SIGNATURE PILE LIFT MECHANISM FOR DEMOGRAPHIC BINDERY LINE

BACKGROUND OF THE INVENTION

I. Field of the Invention

This invention relates generally to signature distributing pockets or hoppers used in high speed bindery equipment, and more particularly to an improved pocket or hopper incorporating a means for preventing the scuffing or marring of printed sheets being fed by such a pocket onto the bindery line conveyor.

II. Discussion of the Prior Art

In a so-called "demographic binder" for magazines and the like, it is possible to custom design the contents of the magazine intended to reach a particular customer or class of customers. Thus, for example, if the marketing department of a major automobile manufacturing company determines from its records that a particular individual customarily purchases a new automobile about every 30 months, in a computer controlled magazine bindery line, it is possible to insure that this particular subscriber will receive a magazine which will include an advertisement for its car product.

A demographic binder gathering section typically includes a large plurality of hoppers or pockets whose signature contents are used to assemble a magazine on a conveyor passing beneath such pockets. In a non-demographic mode, each pocket will deliver a signature to each magazine. In a demographic mode, however, a pocket will deliver a signature only if the specific magazine then passing beneath it is intended to have that particular signature. If that signature is not scheduled to be deposited on the magazine being assembled as it passes beneath that given pocket, no signature is fed at that station as the book progresses along the gathering conveyor.

The existing binder pockets in common use, particularly those manufactured by A.M. Graphics Corporation Model No. RG-318A, embody a two-part dispensing operation. The first part consists of a rotating separator disc that cycles each time that a potential signature transfer could take place. The second part is a vacuum device called a "sucker bar" that functions or not, depending upon whether a signature is to be added to the magazine or omitted.

During each rotation of the separator disc, it touches the bottom of the next signature to be fed and rubs against it. In a non-demographic situation, this is not a problem because, typically, the separator disc will rub against the bottom sheet only once before it is delivered to the magazine being assembled on the underlying conveyor. However, in the case of a demographic printing line, it is possible that many rotations of the separator disc may take place before a given page is withdrawn from its pocket or hopper. It has been found that the repeated rubbing of the rotating separator disc with the bottom of the signature next to be dispensed can abrade that surface, rendering it unsightly and unacceptable by the magazine publisher. It is this problem that the present invention addresses.

SUMMARY OF THE INVENTION

To avoid the problem of marring and abrading of signature pages in a demographic bindery line incorporating a large plurality of pockets or hoppers of the type described, we have incorporated a pile lift mechanism into the pocket which functions to prevent the bottommost signature in a stack from coming into contact with the rotating separator plate when it is determined that a predetermined number of cycles are to take place before that particular hopper will be called upon to deposit its bottommost signature of the stack onto the bindery line conveyor, via the pocket drum. This result is achieved in accordance with this invention by providing a hinged lift plate along the forward edge of the signature pile support tray, with that hinged lift plate being operated by an air cylinder type linear actuator coupled to an air solenoid valve. The main computer for the bindery line, which controls all aspects of the magazine production run, is capable of determining the number of cycles during which a given pocket will not be called upon to distribute a signature and when that count exceeds a preprogrammed value, the solenoid controlled air cylinder is made to lift the hinged plate portion of the signature tray to elevate the forward edge of the pile of signatures to the point where the bottommost signature does not come in contact with the rotating separator disc. When the cycle count falls below the predetermined number, the pneumatic control mechanism will again move the lift plate to its lower disposition which will allow the co-action of the sucker bar and separator disc to pull the bottommost signature in the pile to the point where its leading edge will be engaged by the grippers on the rotating drum. The drum then carries that signature to the location where it is deposited on the magazine being assembled on the conveyor below. The cycle count threshold is selected such that it is sufficiently low that no significant abrasion of the bottommost signature will take place in the number of cycles involved before selection takes place.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
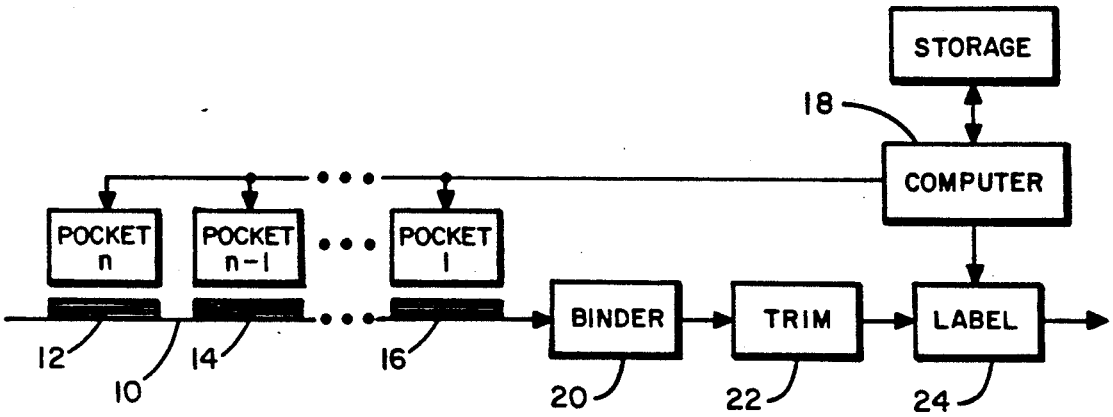
FIG. 1 is a block diagram representation of a demographic bindery line used in producing perfect bound magazines, books, etc.

FIG. 1 illustrates by means of a block diagram a typical demographic bindery line in which the present invention finds use. Here, a large number of pockets or hoppers each contain a stack of signatures and are positioned over a conveyor belt 10 on which magazines are assembled. In a non-demographic mode, each of the pockets 1, 2 . . . N would typically deliver one signature to each magazine as the magazines 12, 14, 16, etc. being assembled pass beneath the pockets on the conveyor 10. In a demographic bindery line, under control of the system computer 18, the pockets are individually controllable so that particular magazines can be customized for a particular subscriber. That is to say, in the demographic mode, a pocket will deliver a signature only if the specific magazine then passing beneath it is supposed to have that particular signature. Once the stack of signatures on the conveyor belt 10 have passed beneath each of the pockets o the bindery line they are appropriately bound at a binder station 20 and subsequently trimmed to a uniform size at a trimming station 22 before passing to a label printing station 24. At the label printing station, again under control of the system computer 18, the individual magazines arriving at the labeling station are provided with a printed address label for the subscriber for who that particular customized magazine is to be directed.

Those skilled in the art will appreciate that in a demographic bindery line, it may happen that a particular pocket may not be actuated to deliver a signature for many machine cycles. For example, if a particular signature containing an advertisement is intended for subscribers whose incomes exceed, say, $100,000.00, many magazines may pass beneath that pocket on the conveyor 10 that are destined to be sent to subscribers that do not meet that earning level before the next one arrives which is to be sent to an individual who does meet the qualifications.

Figure 2:
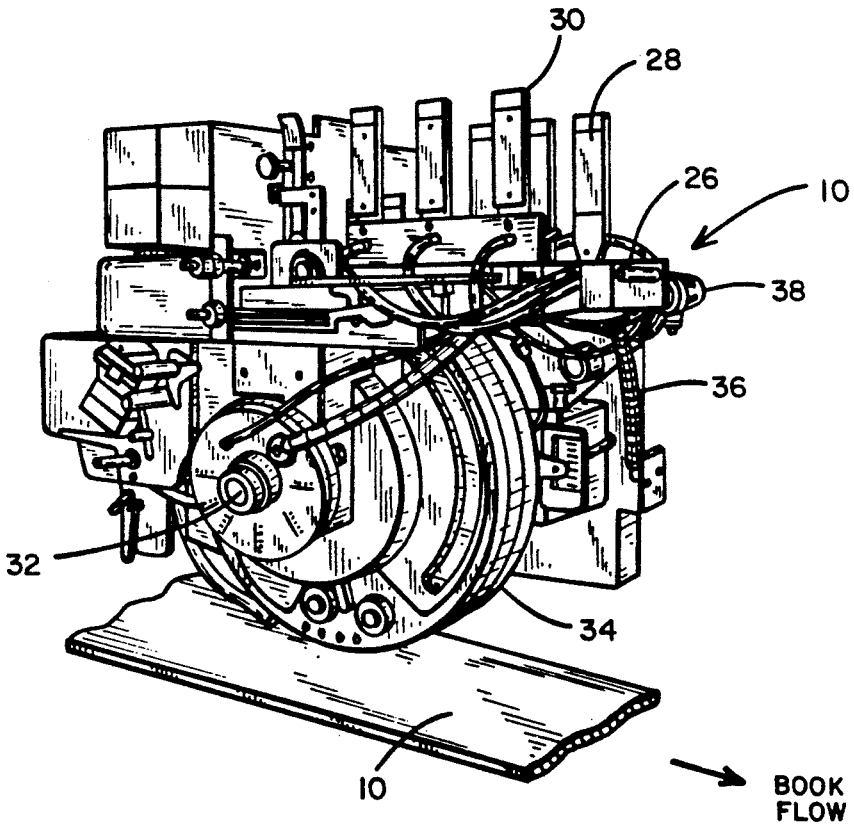
FIG. 2 is a perspective view of a typical pocket used in a demographic bindery line.

With the foregoing in mind, attention is now directed to FIG. 2 which illustrates a perspective view of one of the pockets 1, 2 . . . N used in the demographic bindery line of FIG. 1. The pocket is positioned over the conveyor 10 and includes a signature support tray 26 having adjustable side g ides 28 and 30 for accommodating signatures of differing widths. Disposed beneath the support tray 26 and journaled for rotation about a horizontal axis 32 is a rotatable drum 34. The pocket is driven from the system's main high-speed line shaft (not shown) by a timing belt 36 which connects the line shaft clutch sprocket with a driven sprocket (not shown) located on the pocket's gear box 38. Located at equally spaced intervals along the circumference of the drum 34 are sets of mechanical grippers/fingers which are arranged to clamp onto the leading edge of the bottommost signature in a pile of signatures disposed on the support tray 26 and to extract that bottommost signature from the stack, carrying it downwards and releasing it at the appropriate time so that it will fall onto the top of the magazine being assembled on the conveyor 10. The pocket shown in FIG. 2 comprises an AM Graphics Model RG-318A hopper for use in flatback or perfect binding lines. Those skilled in the art desiring further information on the construction and operation of that device are referred to the operation and maintenance manuals available through AM Graphics Inc. of Dayton, Ohio.

Figure 3:
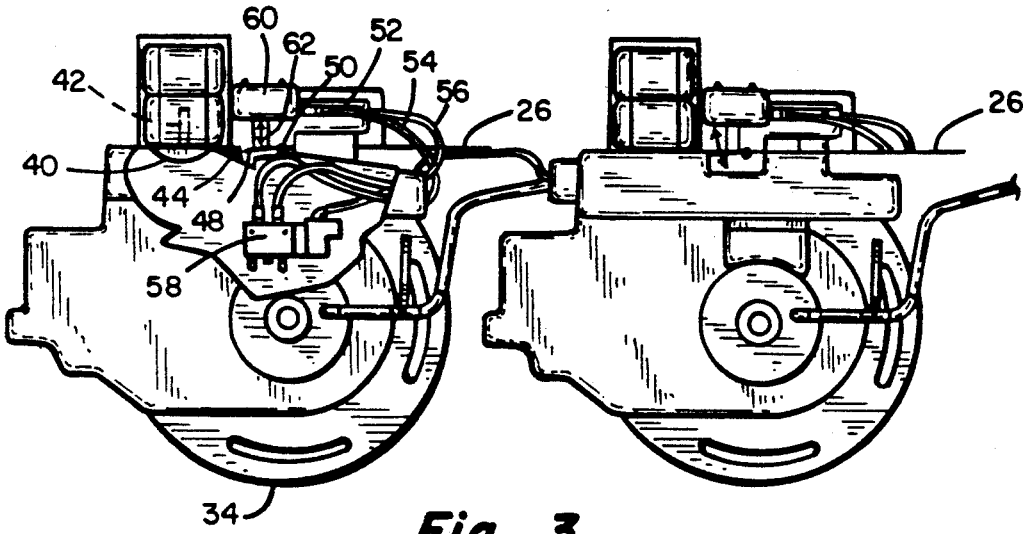
FIG. 3 is a side elevation of the pocket of FIG. 2, partially broken away to reveal the positional cooperation between the rotating separating disc and the signature pile residing on the tray's pocket.

FIG. 3 is a side elevation of two such pockets of FIG. 2 connected in tandem. The leftmost pocket is broken away to reveal the location of a rotatable separator disc 40 which is mounted for rotation about a vertical axis 42. The separator disc is not completely circular, but instead, has a radial segment thereof carried out and the leading edge 44 thereof defined by the cut-out sweeps a circular path just forward of the signature tray 26.

Figure 4:
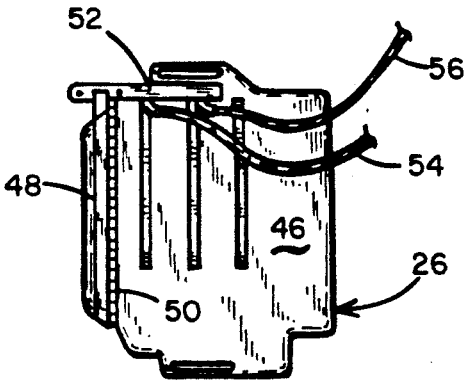
FIG. 4 is a top plan view of the pocket incorporating the present invention.

With reference to FIGS. 3 and the plan view of FIG. 4, the signature tray 26 includes a fixed, stationary portion 46 and a movable flap portion 48 which is hinged to the leftmost edge of the stationary portion by a piano-type hinge 50. Mounted on the stationary support tray 46 is a dual acting pneumatic cylinder 52 which is connected by air lines 54 and 56 to a control solenoid 58, that solenoid being operated from an electrical signal from the computer to introduce pressurized air into either the line 54 or the line 56 leading to the cylinder 52. Air pressure in line 56 causes the piston (not shown) in cylinder 52 to move to the left when viewed in FIG. 3 while air introduced into the line 54 would cause the piston to move from that left position to its rightmost position, again, the directional reference being made relative to FIG. 3. The piston of cylinder 52 enters a linkage housing 60 that is mechanically coupled by means of a linkage 62 to the movable or pivotable flap portion 48 on the support tray 26. Thus, when the linear actuator 52 has its piston moved in a first direction, the hinged portion 48 of the signature support tray 26 becomes generally coplanar with the stationary portion 46. When the linear actuator 52 is operated in the opposite direction, the hinge portion 48 is tilted upward in the clockwise direction out of the plane of the stationary portion 46 of the tray 26.

Figure 5A:
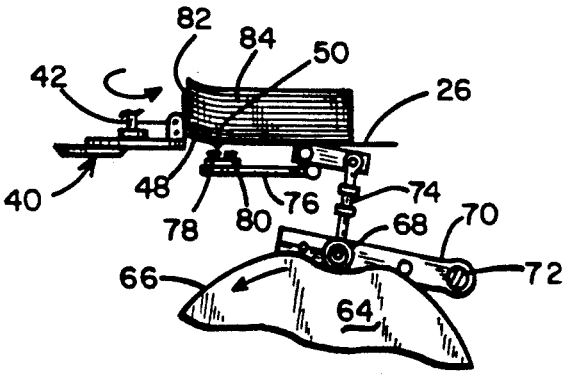
FIGS. 5A, 5B and 5C are partial views helpful in understanding the signature feed operation from a pocket incorporating the present invention.
Figure 5B:
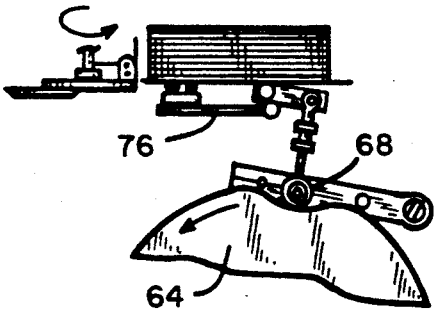
Figure 5C:
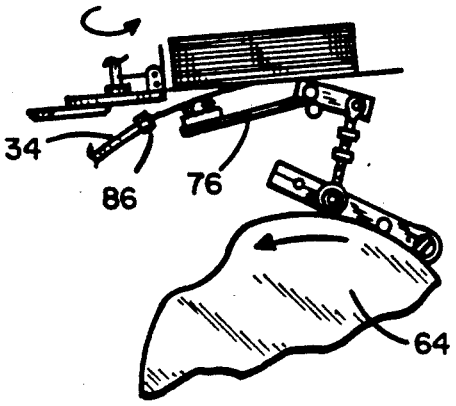

The mechanism forming a portion of the pocket of FIG. 2 for withdrawing the bottommost signature from a stack of signatures residing on the support tray 26 is not shown in the views of FIGS. 2 and 3. However, as is illustrated in FIGS. 5A through 5C, that mechanism includes a clutch-operated cam plate 64 having a cam profile 66 on which a follower 68 rolls. The follower 68 is journaled for rotation on a bar 70 that is pivoted at 72 to a frame member. A linkage 74 of adjustable length is coupled between the bar 70 and a so-called "sucker bar" 76. The sucker bar supports a pair of elastomeric cups 78 and 80 that are coupled by flexible plastic tubing (not shown) to a vacuum source. The sequence of drawings 5A through 5C also show the rotatable separator disc 40 positioned proximate the leading edge 82 of a stack of signatures 84 residing on the signature support tray 26. In the view of FIG. 5A, the tray flap 48 is shown in its elevated position in which it lifts the leading edges of the signatures in the stack 84 upward and out of contact with the separator disc as that separator disc rotates. As mentioned, the computer will control the solenoid 58 (FIG. 3) so that the hinge plate 48 will be elevated if more than a predetermined number of machine cycles will take place before the pocket in question will be called upon to deposit a signature onto the magazine being assembled on the conveyor 10. While the predetermined number is a programmable quantity, it has been found that a threshold setting of 10 machine cycles works well in that less than 10 rotations of the separator plate 40 against the bottommost signature in the stack causes no appreciable marring and abrasion.

In FIG. 5B, the computer has signaled the solenoid 58 that fewer than 10 machine cycles will take place before the pocket must deliver its bottommost signature. Hence, the hinged portion 48 of the signature support tray is shifted to its down position by the actuator 52 and at an appropriate time, the cam 64 cooperating with the follower 68 will cause the sucker bar 76 to rise through the cut-out in the separator disc to the point where the suction cups 78 and 80 engage and adhere to the underside of the bottommost signature in the stack. Shortly thereafter, and as indicated in FIG. 5C, the continued rotation of the cam 64 causes the sucker bar 76 to pivot in the counterclockwise direction, pulling the leading edge of the bottommost signature beneath the separator disc so that the separator disc may cooperate with the upper side of that signature to push the signature down to the point where the gripper fingers 86 on the drum 34 grasp the leading edge of the bottommost signature and pull it off from the bottom of the stack. That signature then travels with the drum 34 downward and the mechanical gripper fingers 86 open at the point in the cycle where the signature being carried is directly above the stack of signatures being assembled on the conveyor belt 10.

The hinged lift plate 48 will remain in its down position until it is determined that a signature will not be required from that particular pocket for more than the predetermined number, e.g. 10, of machine cycles, at which point the solenoid controlled actuator 52 will operate through the linkage assembly 60, 62 to again elevate the hinged portion 48 of the signature support tray and lift the pile sufficiently to prevent contact of the lower signature with the separator disc.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. In a hopper mechanism for use in a demographic book bindery line including a book conveyor, said hopper being of the type including a signature support tray for holding a plurality of signatures in a stacked relation thereon, a rotatable drum having gripping means on the periphery thereof, said drum being disposed beneath said signature support tray and journaled for rotation about a generally horizontal axis, a separator disc disposed proximate one end of said support tray and journaled for rotation about a generally vertical axis, said separator disc having a radial opening formed through its thickness dimension, and a cam actuated vacuum sucker synchronized to the rotation of said drum and said separator disc for periodically extending through said radial opening in said separator disc for grasping and deflecting the leading edge of the bottommost signature in the stack to allow said leading edge to be engaged by said gripping means on said rotating drum, the improvement comprising:

(a) means coupled to said support tray for selectively preventing engagement of said bottommost signature by said separator disc.

2. The apparatus as in claim 1 wherein said preventing means comprises:

(a) means for elevating the leading edges of the signatures in said stack relative to the plane of said support tray.

3. The apparatus as in claim 2 wherein said elevating means comprises:

(a) a lift plate;

(b) hinge means coupling said lift plate to said support tray such that said lift plate lies beneath said leading edges of the signature in said stack; and (c) actuator means for periodically tipping said lift plate out of the plane of said support tray upwards about said hinge means.

4. The apparatus as in claim 3 wherein said actuator means includes a solenoid controlled linear actuator operatively coupled to said lift plate.

5. The apparatus as in claim 3 wherein said actuator means includes means for sensing when said hopper mechanism will not be called upon to deposit a signature onto said book conveyor for a predetermined number of cycles of rotation of said separator disc.

6. The apparatus as in claim 4 and further including sensing means for determining when said hopper mechanism will not be called upon to deposit a signature onto said book conveyor for a predetermined number of cycles of said separator disc; and means responsive to said sensing means for operating said solenoid.

* * * * *